US006460703B1

(12) United States Patent
Thompson et al.

(10) Patent No.: US 6,460,703 B1
(45) Date of Patent: Oct. 8, 2002

(54) DISPLAY BOX AND METHOD FOR PACKAGING AN ARTICLE IN THE BOX

(75) Inventors: Chad A. Thompson, Racine, WI (US); Dennis M. Bukovich, Chippewa, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 8 days.

(21) Appl. No.: 09/861,953

(22) Filed: May 21, 2001

(51) Int. Cl.[7] ..... B65D 25/54

(52) U.S. Cl. ..... 206/779; 206/775; 206/68; 206/769; 229/162; D9/418

(58) Field of Search ..... 206/775–783, 206/486, 723, 476, 418, 756, 763, 765, 769, 525, 68, 426; 229/162, 116.1; D9/414, 415, 418

(56) References Cited

U.S. PATENT DOCUMENTS 616,548 A * 12/1898 Mason ..... 206/68
3,517,801 A * 6/1970 Cote ..... 206/756
3,750,870 A * 8/1973 Cote ..... 206/277
3,770,116 A * 11/1973 Cote ..... 206/780
3,777,883 A * 12/1973 Hackenberg ..... 206/780
4,171,050 A * 10/1979 Murray et al. ..... 206/446
4,242,984 A * 1/1981 Smith ..... 119/52.2
4,848,563 A * 7/1989 Robbins ..... 206/315.9
5,205,730 A 4/1993 Capdeville
5,332,085 A 7/1994 Fraser
5,495,937 A 3/1996 Fraser
5,826,727 A 10/1998 Fraser
6,033,212 A 3/2000 Bonnema et al.
D455,956 S * 4/2002 Thompson et al. ..... D9/415

FOREIGN PATENT DOCUMENTS

WO WO00/78135 A2 12/2000

* cited by examiner

*Primary Examiner*—Mickey Yu
*Assistant Examiner*—Jila M. Mohandesi

(57) ABSTRACT

A box includes bottom, opposed side, front, top, and rear panels, which define an interior space of the box. The box has a display opening and an invertible panel that includes a top edge. The invertible panel may include a first section coplanar with the front panel and a second section coplanar with a side panel when the invertible panel is in an unflexed position. In the unflexed position, a vertical passageway is formed behind the invertible panel and in front of the top panel. An article having a body depending from an elongated support can be packaged in the box by placing the support in the vertical passageway and positioning the body in the display opening. Force is applied to the article and/or the invertible panel whereby the invertible panel is moved into a second position and the article is contained within the interior space of the box.

19 Claims, 7 Drawing Sheets

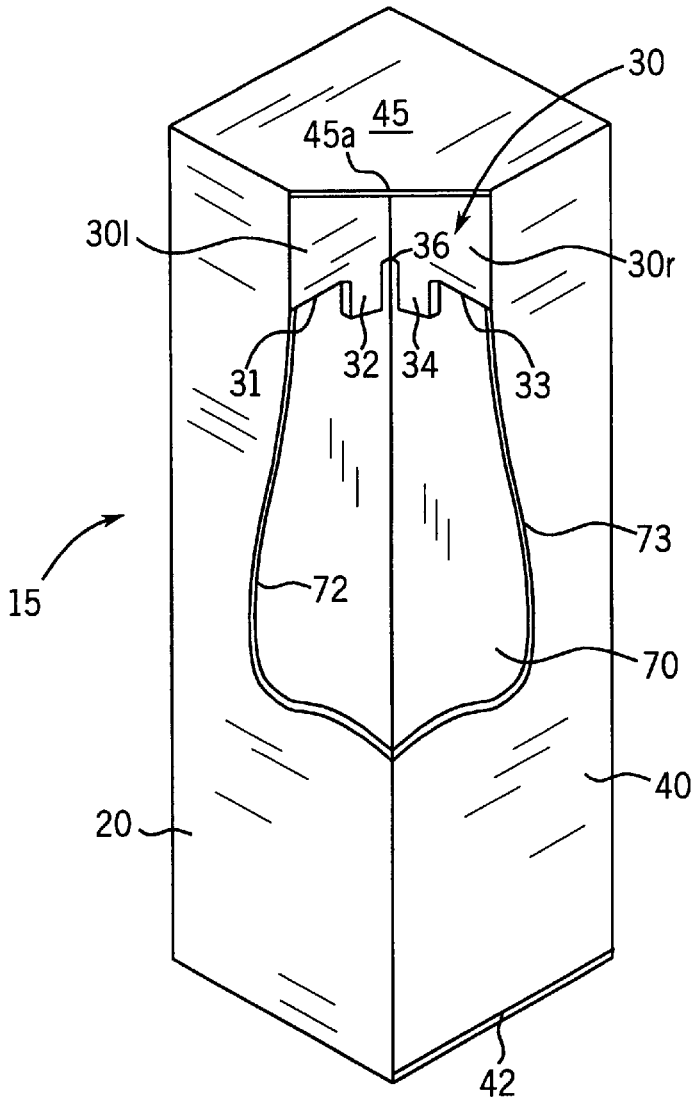
FIG. 2
FIG. 4
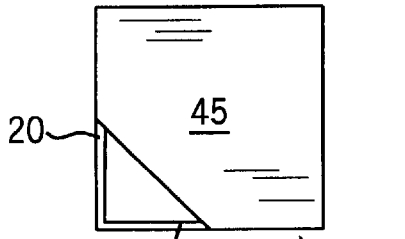
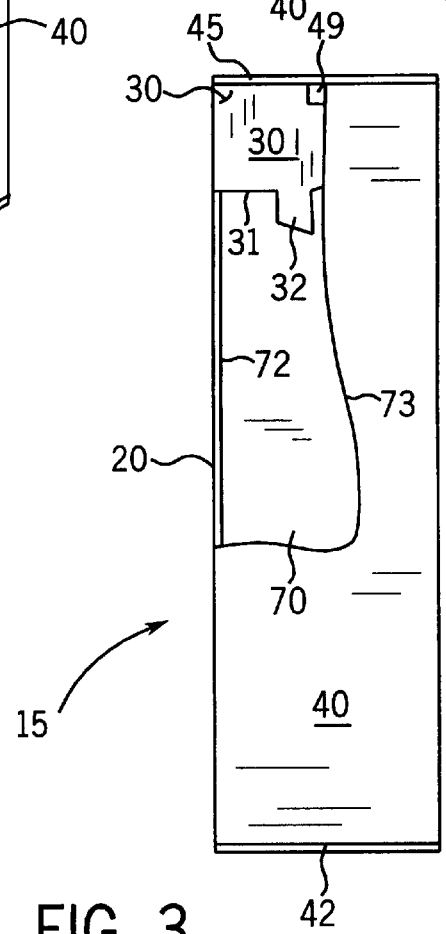
FIG. 3

FIG. 5
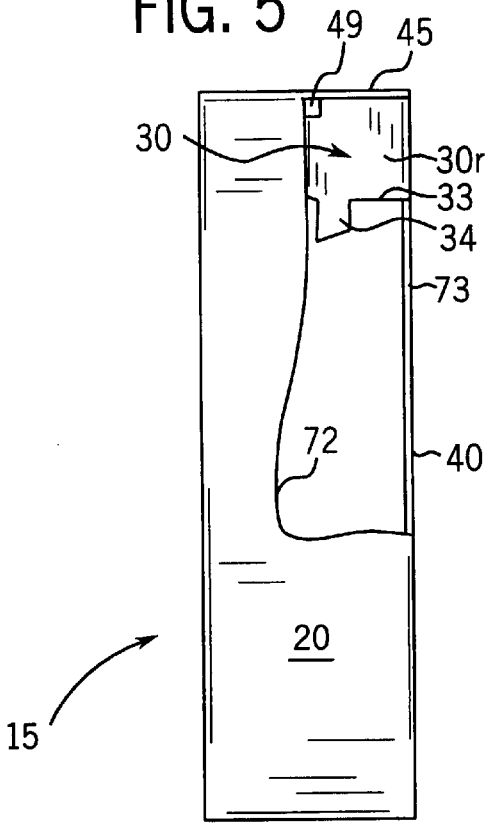
FIG.6
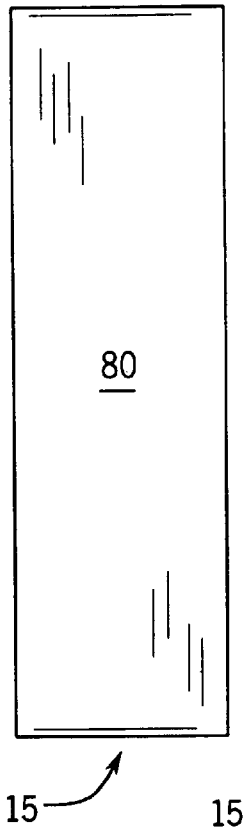
FIG.7
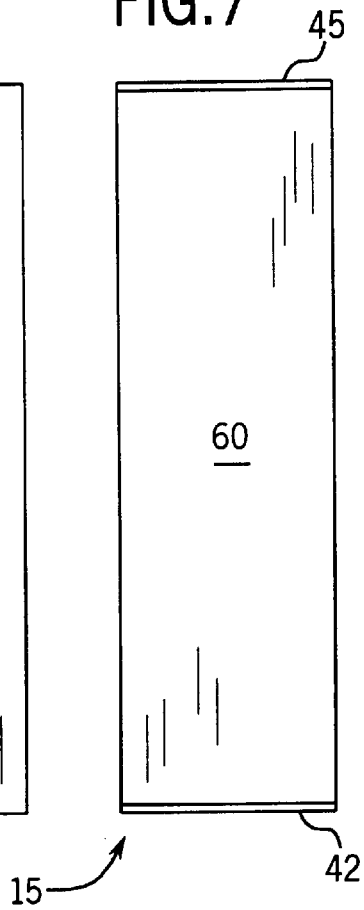
FIG. 7B
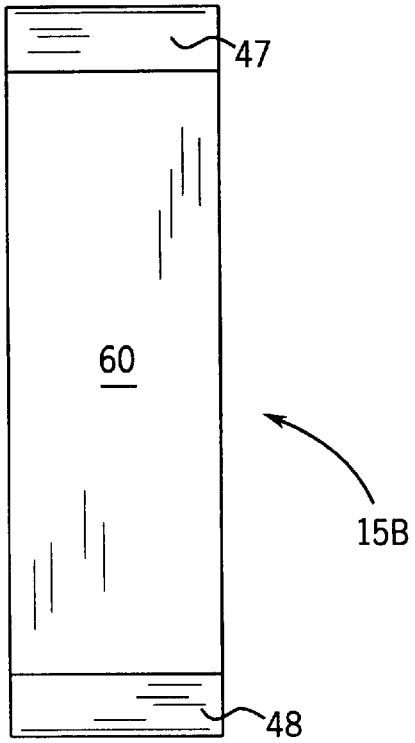
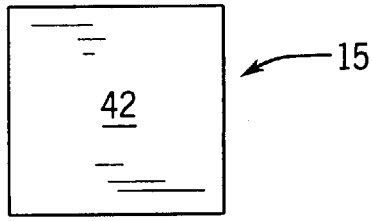
FIG. 8

FIG. 9
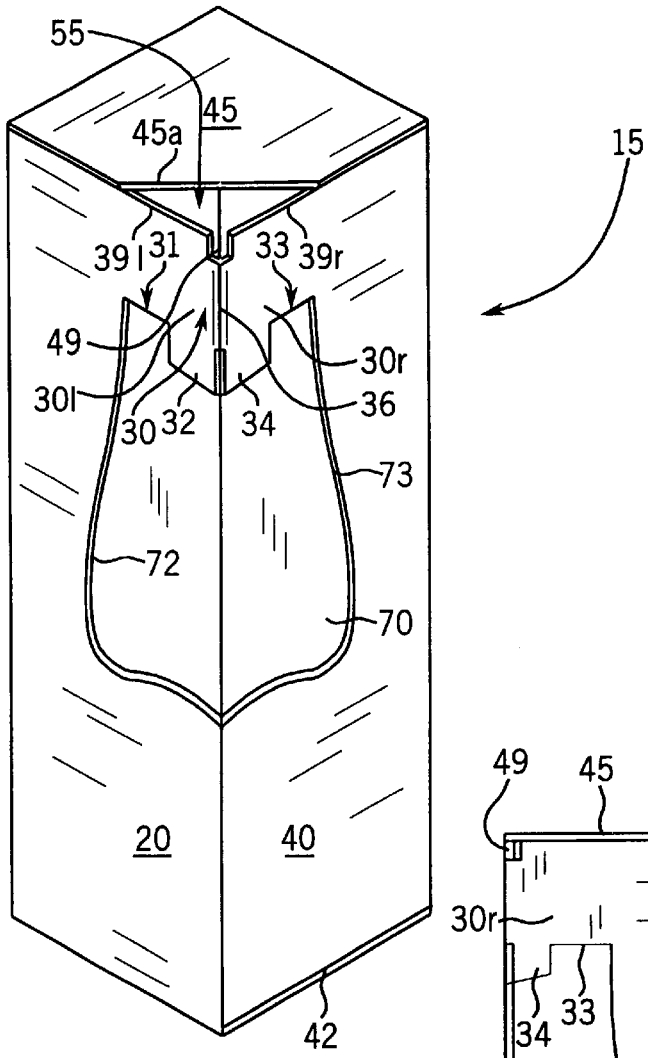
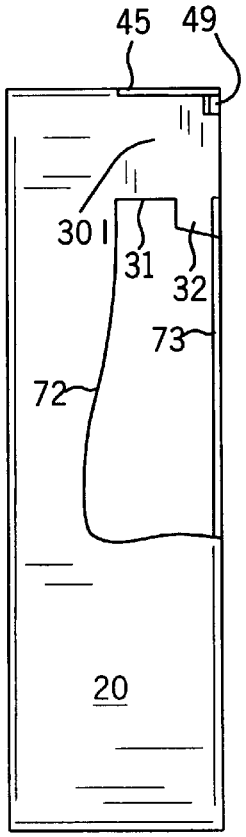
FIG. 12
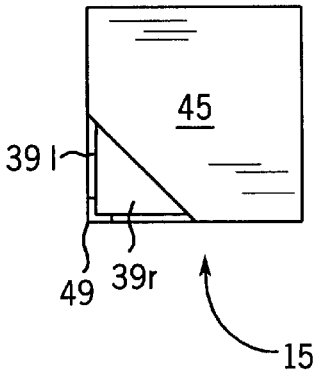
FIG. 11
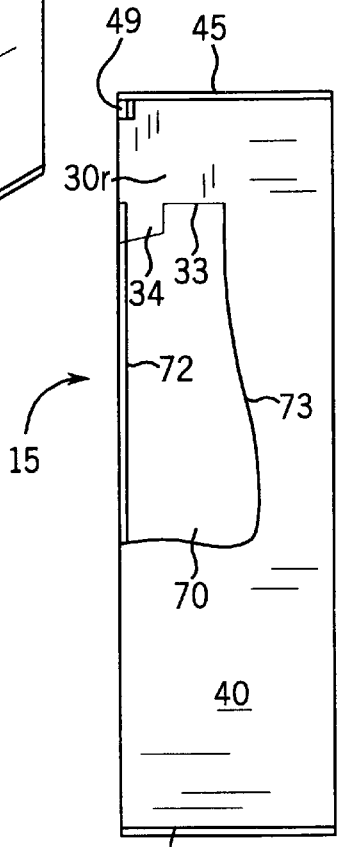
FIG. 10

FIG. 13
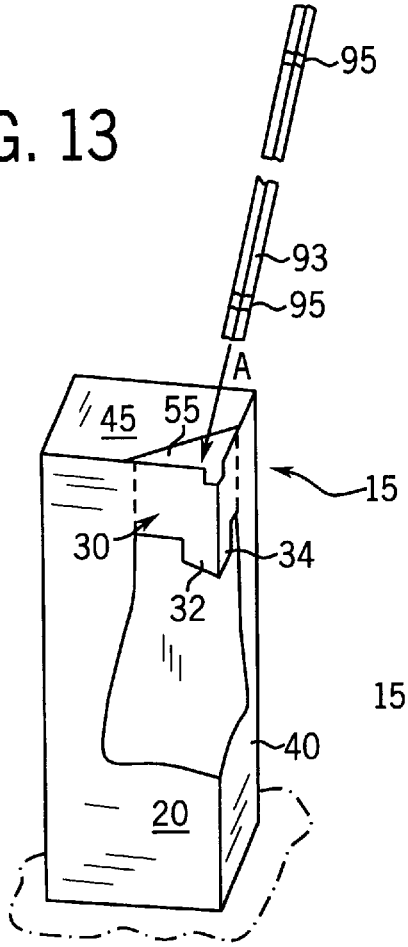
FIG. 14
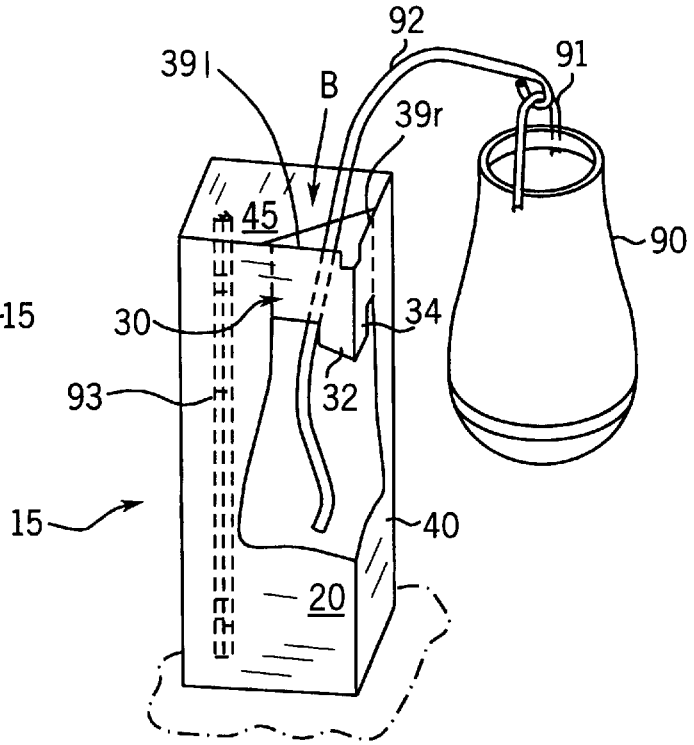
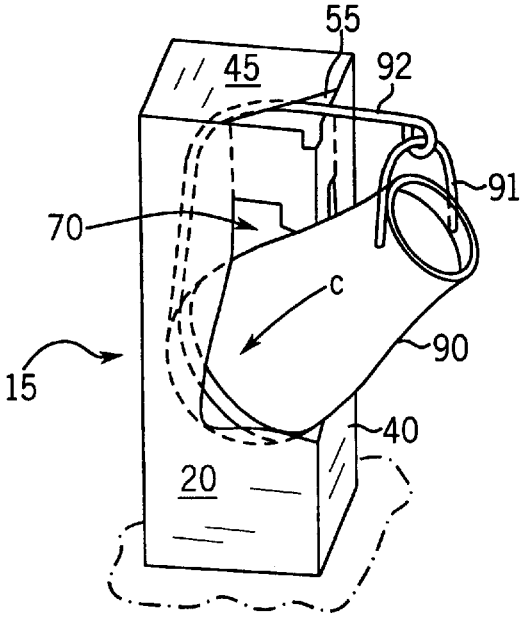
FIG. 15
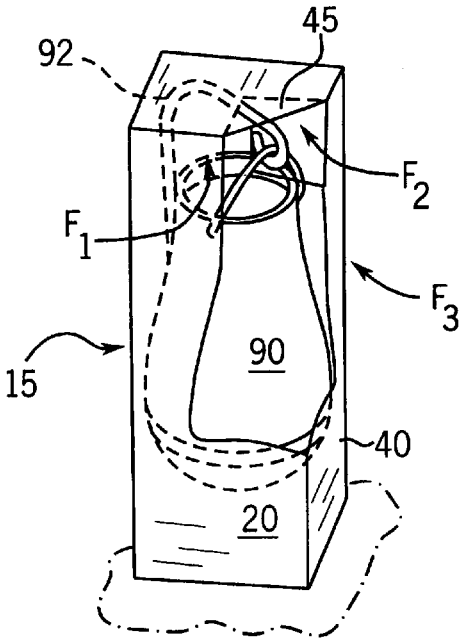
FIG. 16

FIG. 17
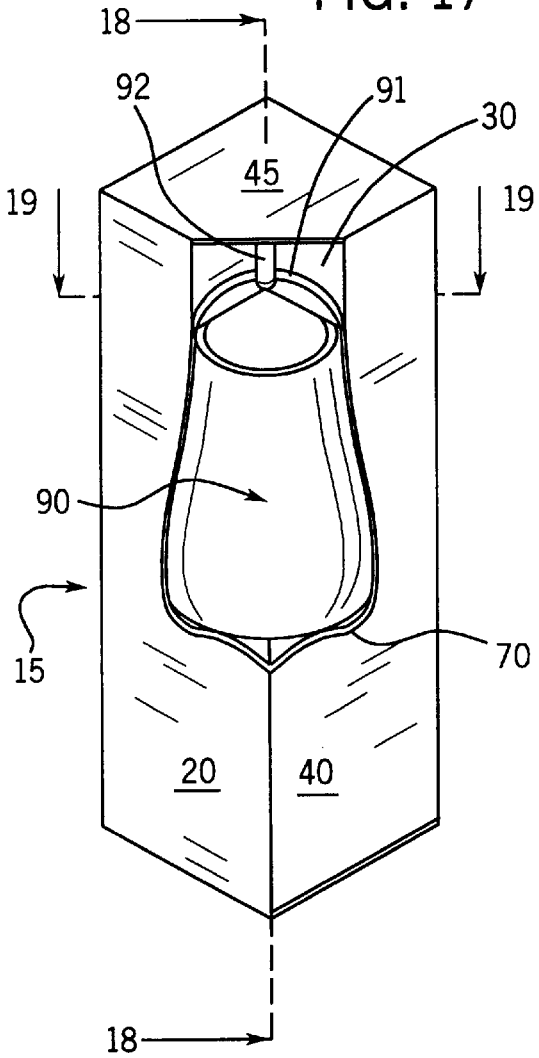
FIG. 18
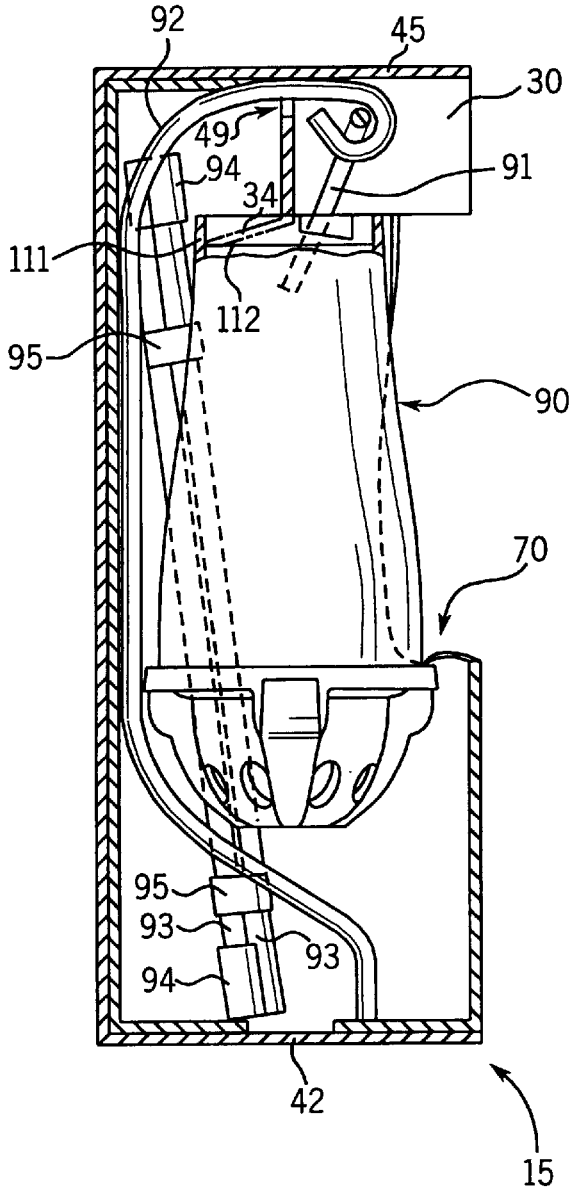
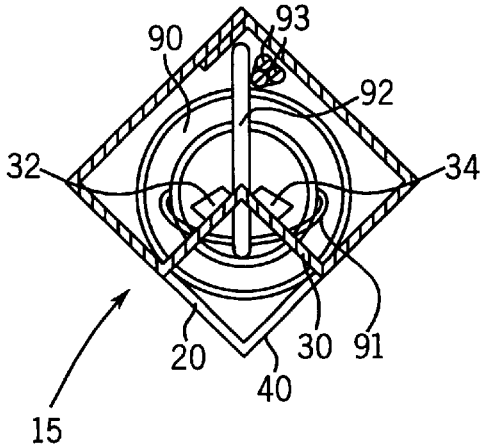
FIG. 19

DISPLAY BOX AND METHOD FOR PACKAGING AN ARTICLE IN THE BOX

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates to boxes for displaying a product sold at retail, such as a lamp, and more particularly, to a display box that is configured to provide for a cost effective product packaging process at the place of product packaging.

2. Description of the Related Art

After being manufactured, retail products, such as lamps and the like, are commonly packaged in a box for containing, transporting, and preferably, displaying the product at a retail location. Frequently, retailers want to display such products so that the appearance of the product can be viewed by prospective buyers. While manufacturers are certainly interested in providing a box that attractively displays their product, manufacturers are also concerned with the manufacturing costs associated with loading the product into the display box at the manufacturing or distribution site. A box that provides optimum product display characteristics may not provide for a cost effective packaging process at the manufacturing or distribution site.

Therefore, there is a continuing need for product display boxes having improved product display characteristics and having a configuration that allows the box to loaded with a product at a manufacturing site using a cost effective packaging process.

BRIEF SUMMARY OF THE INVENTION

The foregoing needs are met by a box according to the invention which includes a bottom panel, a first side panel, a second side panel, a front panel, a top panel, a rear panel, a display opening having a perimeter, and an invertible panel. The bottom panel, the first side panel, the second side panel, the front panel, the top panel and the rear panel define an interior space of the box. The first side panel, the second side panel, the front panel, and the rear panel are foldably joined at their lower edges to the bottom panel and are foldably joined at their upper edges to the top panel. The first side panel and the second side panel are foldably joined at their front edges to the front panel and are foldably joined at their rear edges to the rear panel. The display opening is formed between at least a portion of the first side panel and at least a portion of the front panel.

The invertible panel of the box includes a top edge, a bottom edge, and opposed side edges, and is located above the display opening. The majority of the top edge of the invertible panel is not joined to any panels of the box and the majority of the bottom edge of the invertible panel is not joined to any panels of the box. One side edge of the invertible panel is foldably joined to the front panel and the other side edge of the invertible panel is foldably joined to the first side panel so that the invertible panel can be moved between a first position and a second position that is nearer a central portion of the interior space of the box than the first position.

In one form of the box, the invertible panel includes a first section and a second section wherein the first section is substantially coplanar with the front panel and the second section is substantially coplanar with the first side panel when the invertible panel is in the first position. In this form, the top panel is dimensioned such that a vertical passageway is formed behind the invertible panel when the invertible panel is in the first position. This form of the box allows the box to loaded with an article at a manufacturing site using a cost effective packaging process. Specifically, a person packaging the article is provided with this form of the box and an article having a body and a movable elongated support. The elongated support is placed into the vertical passageway such that a portion of the elongated support is above or rests on the top edge of the invertible panel. The body of the article is then positioned in the display opening of the box. A force is then applied to the article and/or the invertible panel whereby the invertible panel is moved into the second position and the article is contained within the interior space of the box.

It is therefore an advantage of the present invention to provide a box that allows retailers to display a product so that the appearance of the product can be viewed by prospective buyers.

It is another advantage of the present invention to provide a box having improved product display characteristics and having a configuration that allows the box to loaded with a product at a manufacturing site using a cost effective packaging process.

These and other features, aspects, and advantages of the present invention will become better understood upon consideration of the following detailed description, drawings, and appended claims.

BRIEF DESCRIPTION OF THE DRAWINGS

FIG. 2 is a front perspective view from above and to one side of a display box in accordance with the present invention produced from the sheet of box material shown in FIG. 1A, the box having the invertible panel pushed inward;

FIG. 3 is a right side elevational view of the box of FIG. 2;

FIG. 4 is a top plan view of the box of FIG. 2;

FIG. 5 is a front view of the box of FIG. 2;

FIG. 6 is a rear view of the box of FIG. 2;

FIG. 7 is a left side elevational view of the box of FIG. 2;

FIG. 7B is a left side elevational view of another display box in accordance with the invention produced from the blank shown in FIG. 1B;

FIG. 8 is a bottom plan view of the box of FIG. 2;

FIG. 9 is a front perspective view from above and to one side of the display box of FIG. 2 with the invertible panel pulled outward;

FIG. 10 is a right side elevational view of the box of FIG. 9;

FIG. 11 is a plan view of the box of FIG. 9;

FIG. 12 is a plan view of the box of FIG. 9;

FIG. 13 is a front perspective view from above and to one side of a display box in accordance with the present invention being loaded with a first component of a product;

FIG. 14 is a front perspective view from above and to one side of a display box in accordance with the present invention being loaded with a second component of the product;

FIG. 15 is a front perspective view from above and to one side of a display box in accordance with the present invention being further loaded with the second component of the product;

FIG. 16 is a front perspective view from above and to one side of a display box in accordance with the present invention loaded with the product;

FIG. 17 is a front perspective view from above and to one side of a display box in accordance with the present invention having the product packaged therein;

FIG. 18 is a cross-sectional view taken along line 18—18 of FIG. 17; and FIG. 19 is a cross-sectional view taken along line 19—19 of FIG. 17.

Figure 1A:
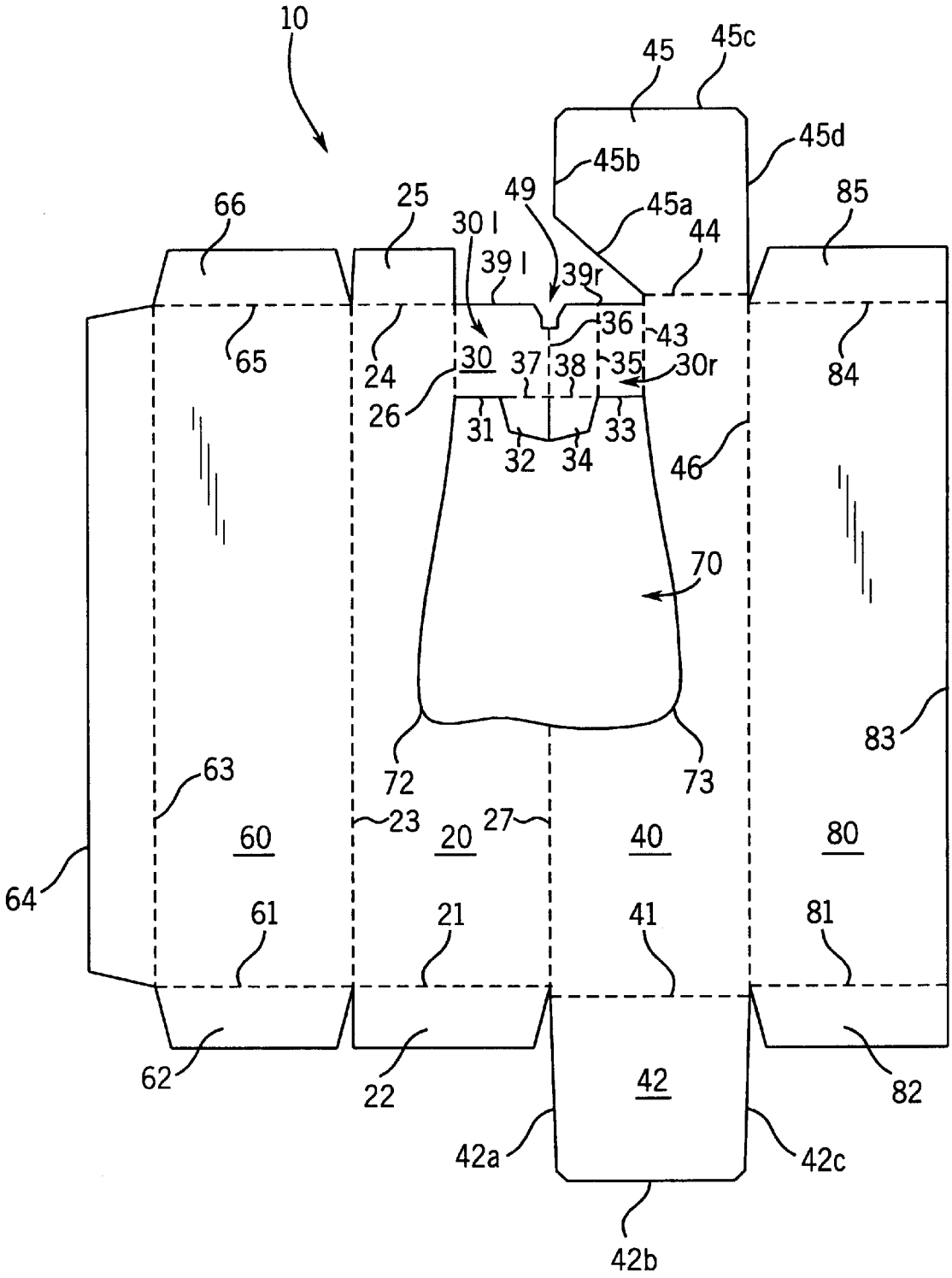
FIG. 1A is a top view showing a flat planar sheet of box material, such as cardboard, that is cut, creased and assembled to form a display box in accordance with the invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

Like reference numerals will be used to refer to like or similar parts from Figure to Figure in the following description of the drawings.

DETAILED DESCRIPTION

Referring now to FIG. 1A, a display box in accordance with the invention can be formed from a single planar rectangular blank of box material indicated generally at 10. The box material may be cardboard, corrugated paperboard, stiffened plastic sheeting, or other any other conventional box material. The blank 10 can be formed by the use of a single die having sharp blade edges to make cuts through the box material, as illustrated by the solid lines in FIG. 1A, and blunted edges that are pressed into the box material to form crease lines, as illustrated by the dashed lines in FIG. 1A. Any of the crease lines depicted in FIG. 1A or any of the other Figures may be a crease line or the combination of one or more crease lines and one or more cuts. The blank 10 can then be folded along the crease lines and selected flaps of the blank 10 can be secured to selected panels by conventional means, such as gluing or stapling, to form the display box.

The blank 10 includes a front panel 20, a right panel 40, a left panel 60, a rear panel 80, a bottom panel 42 and a top panel 45. When the blank 10 is assembled into a display box in accordance with the invention, the front panel 20, right panel 40, left panel 60, rear panel 80, bottom panel 42 and top panel 45 form the front, right, left, rear, bottom and top sides of the display box. It should be understood that when describing the panels of the blank or the sides of the display box, the terms front, right, left, rear, bottom and top have been used for convenience and do not imply that the display box must be arranged with the front of the display box facing a viewer. However, in an example use for the display box, a viewer facing the display box would be looking at the front panel of the box, with the bottom panel of the box typically resting on a display surface. In addition, when the term "substantially" is used herein with reference to the shape of flaps or panels, the term "substantially" means that the flap or panel may vary slightly from the general geometric shape such as by the rounding or chamfering of corners.

The front panel 20 is. hinged to the left panel 60 by a crease lines 23 and is hinged to the right panel 40 by a crease line 27. The right panel 40 is hinged to the rear panel 80 by a crease line 46. The substantially trapezoidal top panel 45 is hinged to the right panel 40 by a crease line 44 and the substantially rectangular bottom panel 42 is hinged to the right panel 40 by a crease line 41. The perimeter of the top panel 45 is formed by edges 45*a*, 45*b*, 45*c* and 45*d* and may include chamfered or rounded corners at the intersection of any of the edges 45*a*, 45*b*, 45*c* and 45*d*. The perimeter of the bottom panel 42 is formed by edges 42*a*, 42*b*, and 42*c* and may include chamfered or rounded corners at the intersection of any of the edges 42*a*, 42*b* and 42*c*.

Assembly flaps 82, 22, 64, 66, 25 and 85 are arranged around the blank in strategic locations to allow for assembly of a display box in accordance with-the invention. Substantially trapezoidal assembly flap 82 is hinged to the bottom of the rear panel 80 by a crease line 81. Substantially trapezoidal assembly flap 22 is hinged to the bottom of the front panel 20 by a crease line 21. Substantially trapezoidal assembly flap 64 is hinged to the side of the left panel 60 by a crease line 63. Substantially trapezoidal assembly flap 66 is hinged to the top of the left panel 60 by a crease line 65. Substantially rectangular assembly flap 25 is hinged to the top of the front panel 20 by a crease line 24. Substantially trapezoidal assembly flap 85 is hinged to the top of the rear panel 80 by a crease line 84.

The blank 10 includes an invertible panel 30 that is arranged between the front panel 20 and the right panel 40. A left section 301 of the invertible panel 30 is hinged to the front panel 20 by a crease line 26 and a right section 30*r* of the invertible panel 30 is hinged to the right panel 40 by a crease line 43. The upper edge of the invertible panel 30 comprises upper edge 391 and upper edge 39*r* that are spaced apart by notch 49. The lower edge of the invertible panel 30 includes spaced apart lower edge 31 and lower edge 33. A display hole 70 is defined in the blank 10 by the invertible panel 30, a curvilinear inner edge 72 of the front panel 20, and a curvilinear inner edge 73 of the right panel 40.

Extending downward from the invertible panel 30 is a left retention tab 32 that is hinged to the left section 301 of the invertible panel 30 by a crease line 37. Also extending downward from the invertible panel 30 is a right retention tab 34 that is hinged to the right section 30*r* of the invertible panel 30 by a crease line 38. At the center of the invertible panel 30, there is a crease line 36 that runs from the notch 49 to the intersection of crease line 37 and crease line 38. The right section 30*r* of the invertible panel 30 also includes a crease line 35 that runs from the upper edge 39*r* of the invertible panel 30 to the intersection of the crease line 38 and the lower edge 33 of the invertible panel 30.

Figure 1B:
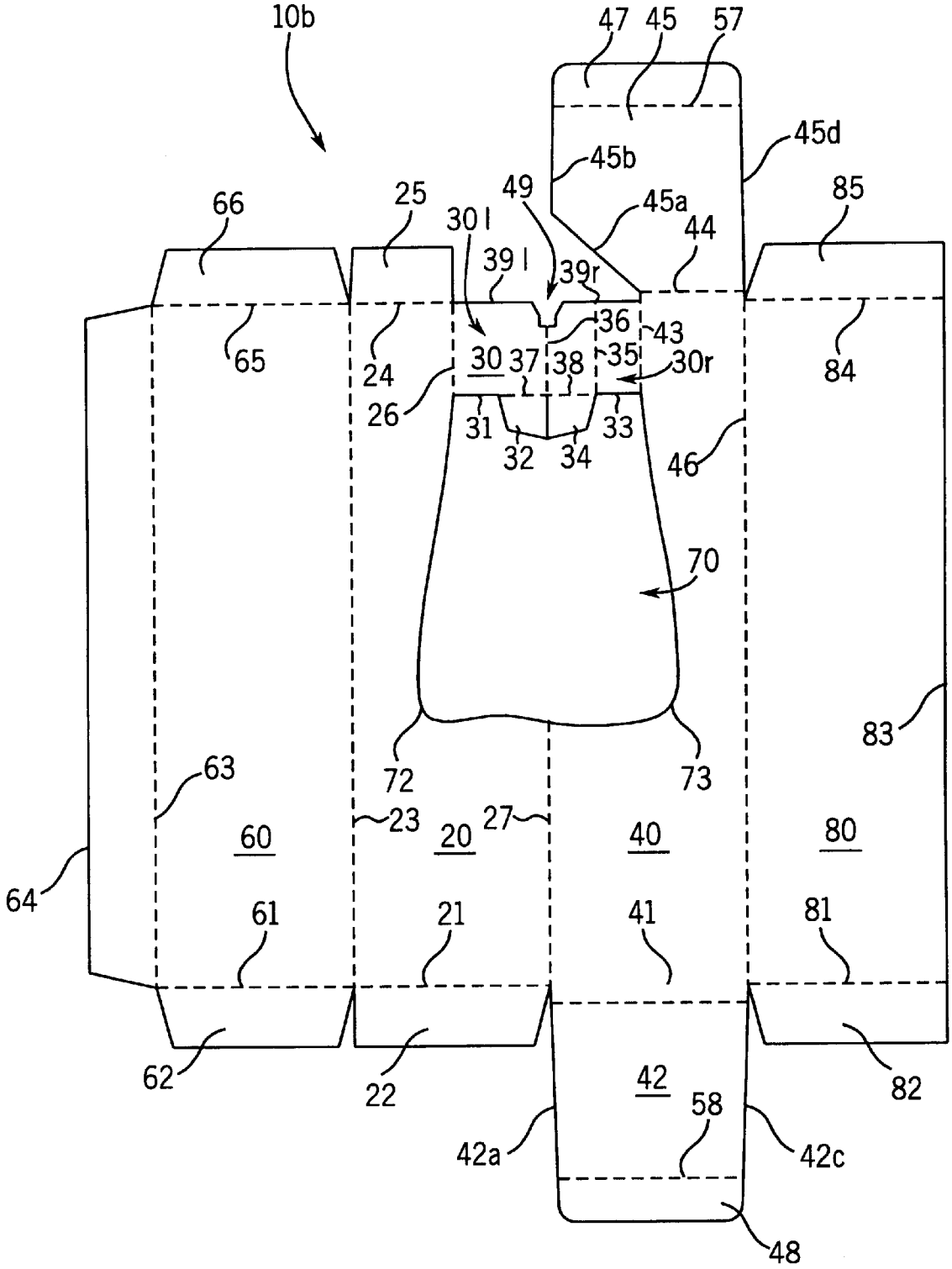
FIG. 1B is a top view showing another flat planar sheet of box material, such as cardboard, that is cut, creased and assembled to form another display box in accordance with the invention.

Referring now to FIG. 1B, another display box in accordance with the invention can be formed from a single planar rectangular blank of box material indicated generally at 10B. The blank 10B includes all of the features of the blank 10 of FIG. 1A. However, the blank 10B includes two additional assembly flaps 47 and 48. Assembly flap 47 is hinged to the top of the top panel 45 by a crease line 57, and assembly flap 48 is hinged to the bottom of the bottom panel 42 by a crease line 58.

The blank 10 of FIG. 1A can be assembled into the display box 15 shown in FIGS. 2, 3, 4, 5, 6, 7, 8, 9, 10, 11 and 12 using (among other methods) the following steps (the sequence of which can be altered). The rear panel 80 is folded 90 degrees rearward (i.e., into the plane of the drawing of FIG. 1A) along crease line 46 and then the right panel 40 is folded 90 degrees rearward (i.e., into the plane of the drawing of FIG. 1A) along crease lines 27 and 36. The assembly flap 64 is then folded 90 degrees rearward (i.e., into the plane of the drawing of FIG. 1A) along crease line 63. The left panel 60 is then folded 90 degrees rearward (i.e., into the plane of the drawing of FIG. 1A) along crease line 23. The assembly flap 64 may then be secured (such as by gluing) to the interior of the rear panel 80 near the edge 83 of the rear panel 80.

Next, assembly flap 66 is folded 90 degrees downward along crease line 65, assembly flap 25 is folded 90 degrees downward along crease line 24, and assembly flap 85 is folded 90 degrees downward along crease line 84. Glue may then be applied to the top surfaces of assembly flaps 66, 25 and 85, and top panel 45 is folded 90 degrees downward along crease line 44 to secure the top surfaces of assembly flaps 66, 25 and 85 to the bottom surface of the top panel 45. Then, assembly flap 62 is folded 90 degrees upward along crease line 61, assembly flap 22 is folded 90 degrees upward along crease line 21, and assembly flap 82 is folded 90 degrees upward along crease line 81. Glue may then be applied to the bottom surfaces of assembly flaps 62, 22 and 82, and bottom panel 42 is folded 90 degrees upward along crease line 41 to secure the bottom surfaces of assembly flaps 62, 22 and 82 to the top surface of the bottom panel 42.

After this assembly process, the display box 15 will be configured as shown in FIGS. 6 to 12. During subsequent processing in a packaging process (as described below), the invertible panel 30 is pressed inward such that the display box 15 is configured as shown in FIGS. 1 to 8. In order for the display box 15 to assume the configuration of FIGS. 1 to 8, the invertible panel is folded inward along crease line 36 and inward along crease lines 43 and 26. The angle of the folds along crease lines 26, 36 and 43 will vary depending on the dimensions of the invertible panel 30. The left retention tab 32 and the right retention tab 34 may also be folded inward along crease lines 37 and 28 respectively during subsequent processing in a packaging process.

The blank 10B of FIG. 1B can be assembled into another display box 15B which is identical to the display box 15 in the views of FIGS. 2, 3, 4, 5, 6, 8, 9, 10, 11 and 12 but has a side view as shown in FIG. 7B. The sequence of assembly steps is the same as above for display box 15 except that (i) when securing the top surfaces of assembly flaps 66, 25 and 85 to the bottom surface of the top panel 45, assembly flap 47 is folded 90 degrees downward along crease line 57 and secured (such as by glue) to the top portion of the left panel 60, and (ii) when securing the bottom surfaces of assembly flaps 62, 22 and 82 to the top surface of the bottom panel 42, assembly flap 48 is folded 90 degrees upward along crease line 58 and secured (such as by glue) to the bottom portion of the left panel 60. It can be appreciated that the assembly flaps 47 and 48 can be located in an alternative position on the top panel 45 and the bottom panel 42 respectively such that the assembly flaps 47 and 48 are secured to the top and bottom portion of the rear panel 80.

Looking at FIGS. 2–12, it can be seen that the invertible panel 30 can flex along crease line 36 (which is intermediate and preferably centered between the opposed side edges or crease lines 26 and 43 of the invertible panel 30) when the invertible panel 30 is moved between a first (unflexed) position as best shown in FIG. 9 and a second (inwardly flexed) position as best shown in FIG. 2. Referring to FIG. 9, it can be seen that the left section 301 of the invertible panel 30 is substantially (i.e., almost completely) coplanar with the front panel 20 and the right section 30*r* is substantially (i.e., almost completely) coplanar with the right panel 40 when the invertible panel 30 is in the first position. In addition, the top panel 45 is dimensioned such that a vertical passageway 55 is formed behind the invertible panel 30 and in front of edge 45*a* of the top panel 45. With this configuration of the top panel 45 and the invertible panel 30, an elongated object can be inserted downward into the vertical passageway 55 when the invertible panel 30 is in the first position.

After the object is inserted in the vertical passageway 55, pressure may be applied to the invertible panel 30 such that the invertible panel 30 flexes along crease lines 26, 36 and 43. Upon the application of pressure, the invertible panel 30 is placed in the second position as shown in FIG. 2 which is nearer a central portion of the interior space of the display box 15 or 15B than the first position. It can be seen that the top panel 45 is dimensioned such that the vertical passageway 55 does not exist behind the invertible panel 30 when the invertible panel 30 is in the second position. With this configuration of the top panel 45 and the invertible panel 30, the invertible panel 30 and the top panel 45 provide a means to contain the elongated object in the interior space of the box 15 or 15B.

Having detailed the construction of a display box according to the invention, the use of the display box in packaging and displaying an article can be described. In order to illustrate the use of a display box according to the invention, a process for packaging a hanging mosquito lantern assembly has been shown in FIGS. 13–19. Looking at FIG. 18, the hanging mosquito lantern assembly includes a number of elongated cylindrical pole segments 93, a number of tubular connector sleeves 94, a curvilinear elongated hanger support 92, and a volatile dispenser (or lamp) 90 with an attached hanger 91. The volatile dispenser 90 with a hanger 91 is fully shown and described in PCT International Publication Number WO 00/78135 A2 which is incorporated herein by reference as if fully set forth herein. The cylindrical pole segments 93 (which are held together by tape 95 when boxed) are assembled into a pole using the connector sleeves 94 and the hanger support 92 is assembled to the top of the pole using a connector sleeve 94. The pole may be inserted into the ground and the volatile dispenser 90 then depends from the hanger support 92 by way of the hanger 91. It should be understood that the display box 15 is suitable for holding other articles, such as those having a body and a movable elongated support.

The steps for packaging the components of the hanging mosquito lantern assembly into the display box 15 are best shown in FIGS. 13–16. In FIG. 13, a group of cylindrical pole segments 93 (which are held together by tape 95) is placed by movement in direction A into the vertical passageway 55 that is formed behind the invertible panel 30 of the box 15. When packaging certain products, this step may be omitted depending on the number of components of the product. Next, as shown in FIG. 14, the curvilinear elongated hanger support 92, which is shown supporting the attached hanger 91 of the volatile dispenser (or lamp) 90, is placed by movement in direction B into the vertical passageway 55 that is formed behind the invertible panel 30 of the box 15. The hanger support 92 is placed into the vertical passageway 55 such that a portion of the hanger support 92 is above or rests on the top edges 39*l*, 39*r* of the invertible panel 30. Preferably, the hanger support 92 rests on or is above the notch 49 in the top edges 39*l*, 39*r* of the invertible panel 30.

Thereafter, the volatile dispenser (or lamp) 90 is placed by movement in direction C into the display opening 70 of the box 15 as shown in FIG. 15. The user then applies a force $F_3$ to the volatile dispenser 90 and/or forces $F_1$, $F_2$ to the invertible panel 30 as shown in FIG. 16. As a result, the invertible panel 30 is thrust back into the interior space of the box 15, inverting and carrying the top of the volatile dispenser 90 to its final position in the box 15 as shown in FIG. 16. The left retention tab 32 and the right retention tab 34 automatically spring downward to clip within the top of the volatile dispenser 90 to secure the volatile dispenser 90 within the box 15. In one example arrangement, the invertible panel 30 preferably remains flexed at crease lines 26, 35, 43 (shown in FIG. 1A) causing the portion of the invertible panel 30 between crease lines 26 and 35 to form a generally, continuous, smooth, curved surface.

After the hanging mosquito lantern assembly is packed into the display box 15, the box and hanging mosquito lantern assembly are arranged as shown in FIGS. 17–19. It can be seen that the invertible panel 30 is arranged such that the invertible panel 30 is set back from a first plane formed by the front panel 20 and a second plane formed by the right panel 40. The hanger support 92 is positioned above or on the top edges 39*l* or 39*r* of the invertible panel, and preferably on or above the notch 49 in the top edges 39*l*, 39*r* of the invertible panel 30. The hanging mosquito lantern assembly is contained within the interior space of the box 15 such that at least a portion of the volatile dispenser 90 is displayed through the display opening 70 of the box 15. The left retention tab 32 and the right retention tab 34 of the invertible panel 30 preferably both contact a top portion 112 of the volatile dispenser 90 as shown in FIGS. 18 and 19 and preferably both contact a rear lip 111 of the top of the volatile dispenser 90 in order to secure the volatile dispenser 90 in the display box 15 against both up and down movement and forward to back movement.

It can be appreciated that the display box according to the invention provides cost advantages when packaging a product, especially a product having a body depending from a movable elongated support. The display box may be delivered to a packaging assembly line fully assembled with all joints and ends glued as is shown in FIG. 9. In this "pre filling" configuration, the invertible panel is in an initial unflexed position. The product may then be packaged in the box by one person using the steps detailed above. When using prior boxes, multiple handling steps and multiple people were needed to pack such a product into a conventional box as the conventional box had end panels that were open to allow the product to be inserted from an end. The end panels then had to be closed and securely fastened to retain the product. When using a display box according to the invention, the packaging process can be accomplished in fewer steps using fewer people.

Although the present invention has been described with reference to certain embodiments, the invention can be practiced by other than the described embodiments, which have been presented for purposes of illustration and not of limitation. Therefore, the scope of the appended claims should not be limited to the description of the embodiments contained herein.

INDUSTRIAL APPLICABILITY

The invention relates to a box for containing and displaying a product sold at retail, and to product packaging processes using the box.

What is claimed is:

1. A box for containing and displaying a product, the box comprising:

a bottom panel, a first side panel, a second side panel, a front panel, a top panel, a rear panel, a display opening having a perimeter, and an invertible panel, the bottom panel, the first side panel, the second side panel, the front panel, the top panel and the rear panel defining an interior space of the box, the first side panel, the second side panel, the front panel, and the rear panel being joined at their lower edges to the bottom panel, the first side panel, the second side panel, the front panel, and the rear panel being joined at their upper edges to the top panel, the first side panel and the second side panel being joined at their front edges to the front panel, the first side panel and the second side panel being joined at their rear edges to the rear panel, the display opening being formed between at least a portion of the first side panel and at least a portion of the front panel, and the invertible panel including a top edge, a bottom edge, and opposed side edges, the invertible panel being located above the display opening, the majority of the top edge of the invertible panel not being joined to any panels of the box, the majority of the bottom edge of the invertible panel not being joined to any panels of the box, one side edge of the invertible panel being joined to the front panel and the other side edge of the invertible panel being joined to the first side panel such that the invertible panel can be moved between a first position and a second position, the second position being nearer a central portion of the interior space of the box than the first position.

2. The box of claim 1, further comprising:

at least one tab extending downward from the bottom edge of the invertible panel.

3. The box of claim 1, further comprising:

a pair of tabs extending downward from the bottom edge of the invertible panel.

4. The box of claim 1, wherein:

the top edge of the invertible panel includes a downwardly extending notch.

5. The box of claim 1, wherein:

the invertible panel can flex along a longitudinal fold line intermediate the opposed side edges of the invertible panel when the invertible panel is moved between the first position and the second position.

6. The box of claim 1, wherein:

the invertible panel includes a first section and a second section, the first section being substantially coplanar with the front panel and the second section being substantially coplanar with the first side panel when the invertible panel is in the first position.

7. The box of claim 1, wherein:

the top panel is dimensioned such that a vertical passageway is formed behind the invertible panel when the invertible panel is in the first position.

8. The box of claim 7, wherein:

the top panel is dimensioned such that a vertical passageway does not exist behind the invertible panel when the invertible panel is in the second position.

9. A one-piece blank for forming the box of claim 1.

10. A boxed article comprising the box of claim 1, and an article having a body and a movable elongated support, wherein the elongated support is positioned above or on the top edge of the invertible panel, and the article is contained within the interior space of the box such that at least a portion of the body of the article is displayed through the display opening.

11. The boxed article of claim 10, wherein:

the top edge of the invertible panel includes a downwardly extending notch, and the elongated support rests in the notch.

12. The boxed article of claim 10, wherein:

the body depends from the movable elongated support.

13. The boxed article of claim 10 wherein:

the invertible panel includes at least one tab extending downward from the bottom edge, and each tab contacts a top portion of the body of the article.

14. The boxed article of claim 10 wherein:

the body of the article is a lamp and the support is a hanger support.

15. A method for packaging in a box an article having a body and a movable elongated support such that the body of the article is displayed, the method comprising:

providing a box having a bottom panel, a first side panel, a second side panel, a front panel, a top panel, a rear panel, a display opening having a perimeter, and an invertible panel, the bottom panel, the first side panel, the second side panel, the front panel, the top panel and the rear panel defining an interior space of the box, the first side panel, the second side panel, the front panel, and the rear panel being joined at their lower edges to the bottom panel, the first side panel, the second side panel, the front panel, and the rear panel being joined at their upper edges to the top panel, the first side panel and the second side panel being joined at their front edges to the front panel, the first side panel and the second side panel being joined at their rear edges to the rear panel, the display opening being formed in at least a portion of the first side panel and at least a portion of the front panel, and the invertible panel including a top edge, a bottom edge, and opposed side edges, the invertible panel being located above the display opening, the majority of the top edge of the invertible panel not being joined to any panels of the box, the majority of the bottom edge of the invertible panel not being joined to any panels of the box, one side edge of the invertible panel being joined to the front panel and the other side edge of the invertible panel being joined to the first side panel such that the invertible panel can be moved between a first position and a second position, the second position being nearer a central portion of the interior space of the box than the first position, the invertible panel being initially in the first position, the top panel being dimensioned such that a vertical passageway is formed behind the invertible panel when the invertible panel is in the first position;

providing an article having a body and a movable elongated support;

placing the elongated support into the vertical passageway such that a portion of the elongated support is above or rests on the top edge of the invertible panel;

positioning the body of the article in the display opening of the box; and applying a force to the article and/or the invertible panel whereby the invertible panel is moved into the second position and the article is contained within the interior space of the box.

16. The method of claim 15 wherein:

the top edge of the invertible panel includes a downwardly extending notch, and the elongated support rests in the notch when the elongated support is placed into the vertical passageway.

17. The method of claim 15 wherein:

the invertible panel includes at least one tab extending downward from the bottom edge, and each tab contacts a top portion of the body of the article when the article is contained within the interior space of the box.

18. The method of claim 15 wherein:

the body depends from the movable elongated support.

19. The method of claim 15 wherein:

the body of the article is a lamp and the support is a hanger support.

* * * * *

US006460703C1

(12) EX PARTE REEXAMINATION CERTIFICATE (4988th)

United States Patent

Thompson et al.

(10) Number: US 6,460,703 C1

(45) Certificate Issued: Sep. 7, 2004

(54) DISPLAY BOX AND METHOD FOR PACKAGING AN ARTICLE IN THE BOX

(75) Inventors: Chad A. Thompson, Racine, WI (US); Dennis M. Bukovich, Chippewa, WI (US)

(73) Assignee: S. C. Johnson & Son, Inc., Racine, WI (US)

Reexamination Request:
No. 90/006,670, Jun. 20, 2003

Reexamination Certificate for:

| | |
|---|---|
| Patent No.: | **6,460,703** |
| Issued: | **Oct. 8, 2002** |
| Appl. No.: | **09/861,953** |
| Filed: | **May 21, 2001** |

(51) Int. Cl.[7] ..... B65D 25/54

(52) U.S. Cl. ..... 206/779; 206/775; 206/68; 206/769; D9/418; 229/162

(58) Field of Search ..... 206/775–783, 206/486, 723, 476, 418, 756, 763, 765, 769, 525, 68, 426, 446, 419, 420, 772, 277; 229/162, 116.1; D9/414, 415, 418

(56) References Cited

U.S. PATENT DOCUMENTS 3,233,726 * 2/1966 Gero ..... 229/120.15
3,584,740 * 6/1971 Hanson ..... 206/780
4,171,050 10/1979 Murray et al.
5,860,526 * 1/1999 Burke, Jr. ..... 206/446

FOREIGN PATENT DOCUMENTS

DE 83 03 822 U 6/1983

* cited by examiner

*Primary Examiner*—David T. Fidei

(57) ABSTRACT

A box includes bottom, opposed side, front, top, and rear panels, which define an interior space of the box. The box has a display opening and an invertible panel that includes a top edge. The invertible panel may include a first section coplanar with the front panel and a second section coplanar with a side panel when the invertible panel is in an unflexed position. In the unflexed position, a vertical passageway is formed behind the invertible panel and in front of the top panel. An article having a body depending from an elongated support can be packaged in the box by placing the support in the vertical passageway and positioning the body in the display opening. Force is applied to the article and/or the invertible panel whereby the invertible panel is moved into a second position and the article is contained within the interior space of the box.

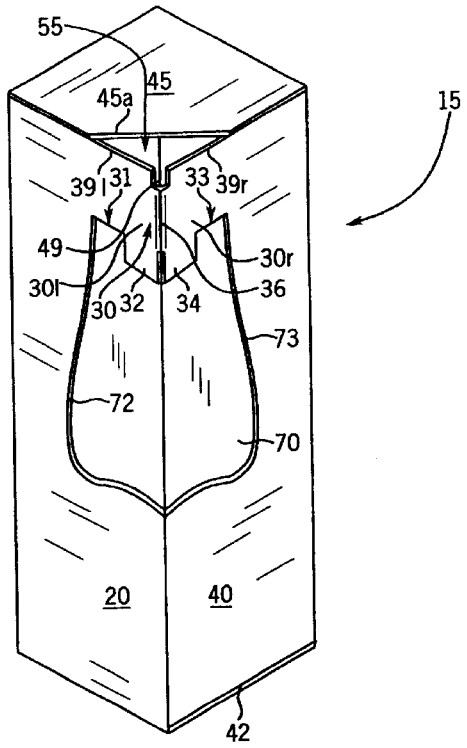

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 15–19 is confirmed.

Claim 4 is cancelled.

Claim 1 is determined to be patentable as amended.

Claims 2, 3 and 5–14, dependent on an amended claim, are determined to be patentable.

New claims 20–37 are added and determined to be patentable.

1. A box for containing and displaying a product, the box comprising:

a bottom panel, a first side panel, a second side panel, a front panel, a top panel, a rear panel, a display opening having a perimeter, and an invertible panel, the bottom panel, the first side panel, the second side panel, the front panel, the top panel and the rear panel defining an interior space of the box, the first side panel, the second side panel, the front panel, and the rear panel being joined at their lower edges to the bottom panel, the first side panel, the second side panel, the front panel, and the rear panel being joined at their upper edges to the top panel, the first side panel and the second side panel being joined at their front edges to the front panel, the first side panel and the second side panel being joined at their rear edges to the rear panel, the display opening being formed between at least a portion of the first side panel and at least a portion of the front panel, and the invertible panel including a top edge, a bottom edge, and opposed side edges, the invertible panel being located above the display opening, the majority of the top edge of the invertible panel not being joined to any panels of the box, the majority of the bottom edge of the invertible panel not being joined to any panels of the box, one side edge of the invertible panel being joined to the front panel and the other side edge of the invertible panel being joined to the first side panel such that the invertible panel can be moved between a first position and a second position, the second position being nearer a central portion of the interior space of the box than the first position,

*wherein the top edge of the invertible panel includes a downwardly extending notch.*

*20. A box for containing and displaying a product, the box comprising:*

*a bottom panel, a first side panel, a second side panel, a front panel, a top panel, a rear panel, a display opening having a perimeter, and an invertible panel,*

*the bottom panel, the first side panel, the second side panel, the front panel, the top panel and the rear panel defining an interior space of the box,*

*the first side panel, the second panel, the front panel, and the rear panel being joined at their lower edges to the bottom panel,*

*the first side panel, the second side panel, the front panel, and the rear panel being joined at their upper edges to the top panel,*

*the first side panel and the second side panel being joined at their front edges to the front panel,*

*the first side panel and the second side panel being joined at their rear edges to the rear panel,*

*the display opening being formed between at least a portion of the first side panel and at least a portion of the front panel, and*

*the invertible panel including a top edge, a bottom edge, and opposed side edges, the invertible panel being located above the display opening, the majority of the top edge of the invertible panel not being joined to any panels of the box, the majority of the bottom edge of the invertible panel not being joined to any panels of the box, one side edge of the invertible panel being joined to the front panel and the other side edge of the invertible panel being joined to the first side panel such that the invertible panel can be moved between a first position and a second position, the second position being nearer a central portion of the interior space of the box than the first position,*

*wherein the top panel is dimensioned such that a vertical passageway is formed behind the invertible panel when the invertible panel is in the first position.*

*21. The box of claim 20, further comprising:*

*at least one tab extending downward from the bottom edge of the invertible panel.*

*22. The box of claim 20, further comprising:*

*a pair of tabs extending downward from the bottom edge of the invertible panel.*

*23. The box of claim 20, wherein:*

*the top edge of the invertible panel includes a downwardly extending notch.*

*24. The box of claim 20, wherein:*

*the invertible panel can flex along a longitudinal fold line intermediate the opposed side edges of the invertible panel when the invertible panel is moved between the first position and the second position.*

*25. The box of claim 20, wherein:*

*the invetible panel includes a first section and a second section, the first section being substantially coplanar with the front panel and the second section being substantially coplanar with the first side panel when the invertible panel is in the first position.*

*26. The box of claim 20, wherein:*

*the top panel is dimensioned such that a vertical passageway does not exist behind the invertible panel when the invertible panel is in the second position.*

*27. A one-piece blank for forming the box of claim 20.*

*28. A boxed article comprising the box of claim 20, and*

*an article having a body and a movable elongated support,*

*wherein the elongated support is positioned above or on the top edge of the invertible panel, and*

*the article is contained within the interior space of the box such that at least a portion of the body of the article is displayed through the display opening.*

*29. The boxed article of claim 28, wherein:*

*the top edge of the invertible panel includes a downwardly extending notch, and the elongated support rests in the notch.*

*30. The boxed article of claim 28, wherein:*

*the body depends from the movable elongated support.*

*31. The boxed article of claim 28 wherein:*

*the invertible panel includes at least one tab extending downward from the bottom edge, and*

*each tab contacts a top portion of the body of the article.*

*32. The boxed article of claim 28 wherein:*

*the body of the article is a lamp and the support is a hanger support.*

*33. A boxed article comprising:*

*a box comprising a bottom panel, a first side panel, a second side panel, a front panel, a top panel, a rear panel, a display opening having a perimeter, and an invertible panel, the bottom panel, the first side panel, the second side panel, the front panel, the top panel and the rear panel defining an interior space of the box, the first panel, the second side panel, the front panel, and the rear panel being joined at their lower edges to the bottom panel, the first side panel, the second side panel, the front panel, and the rear panel being joined at their upper edges to the top panel, the first side panel and the second side panel being joined at their front edges to the front panel, the first side panel and the second side panel being joined at their rear edges to the rear panel, the display opening being formed between at least a portion of the first side panel and at least a portion of the front panel, and the invertible panel including a top edge, a bottom edge, and opposed side edges, the invertible panel being located above the display opening, the majority of the top edge of the invertible panel not being joined to any panels of the box, the majority of the bottom edge of the invertible panel not being joined to any panels of the box, one side edge of the invertible panel being joined to the front panel and the other side edge of the invertible panel being joined to the first side panel such that the invertible panel can be moved between a first position and a second position, the second position being nearer a central portion of the interior space of the box than the first position; and*

*an article having a body and a movable elongated support,*

*wherein the elongated support is positioned above or on the top edge of the invertible panel, and*

*the article is contained within the interior space of the box such that at least a portion of the body of the article is displayed through the display opening.*

*34. The boxed article of claim 33, wherein:*

*the top edge of the invertible panel includes a downwardly extending notch, and the elongated support rests in the notch.*

*35. The boxed article of claim 33, wherein:*

*the body depends from the movable elongated support.*

*36. The boxed article of claim 33 wherein:*

*the invertible panel includes at least one tab extending downward from the bottom edge, and*

*each tab contacts a top portion of the body of the article.*

*37. The boxed article of claim 33 wherein:*

*the body of the article is a lamp and the support is a hanger support.*

* * * * *